United States Patent [19]

Mowbray

[11] 4,418,870

[45] Dec. 6, 1983

[54] FUEL INJECTION NOZZLES

[75] Inventor: Dorian F. Mowbray, Burnham, England

[73] Assignee: Lucas Industries plc, Birmingham, England

[21] Appl. No.: 390,040

[22] Filed: Jun. 18, 1982

[30] Foreign Application Priority Data

Jul. 9, 1981 [GB] United Kingdom ..... 8121231

[51] Int. Cl.[3] ..... F02M 47/00

[52] U.S. Cl. ..... 239/533.8; 239/533.9

[58] Field of Search ..... 239/533.2–533.11, 239/584

[56] References Cited

U.S. PATENT DOCUMENTS 4,186,884 2/1980 Mowbray ..... 239/533.8

4,379,524 4/1983 Andrews ..... 239/533.8

FOREIGN PATENT DOCUMENTS 1412413 11/1975 United Kingdom ..... 239/533.8

*Primary Examiner*—John J. Love

*Assistant Examiner*—Jon M. Rastello

[57] ABSTRACT

A fuel injection nozzle includes a valve member biased by resilient means into contact with a seating to prevent fuel flow through an outlet from an inlet, the valve member being responsive to the pressure at the inlet and opening to allow fuel flow when the pressure attains a predetermined value. A piston member defines a surface against which fuel under pressure in a chamber can act to assist the action of the resilient means. The fuel under pressure in the chamber is obtained from the fuel inlet and is controlled by a valve element slidable within a bore in the piston member. One end of the bore is open to the chamber and the other end to a drain. The element is biased by a spring towards the one end of the bore so that its position in the bore depends upon the pressure in the chamber. The valve element and wall of the bore define groove and a port which form part of a passage means connecting the inlet and the chamber.

4 Claims, 2 Drawing Figures

FUEL INJECTION NOZZLES

This invention relates to fuel injection nozzles of the kind comprising a fuel pressure operable valve member slidable within a bore, a seating located at one end of the bore, the valve member being shaped for cooperation with said seating to prevent fuel flow from an inlet to an outlet, resilient means for biasing the valve member into contact with the seating, a chamber, a valve through which fuel under pressure can flow to said chamber, a surface in said chamber, the fuel pressure acting on said surface to create a force which assists the action of said resilient means.

A nozzle of the aforesaid type is shown in the specification of British Pat. No. 1,412,413 and in the nozzle described in this specification, the aforesaid surface is defmed on a push member or piston which is disposed intermediate the spring and the valve member. The means for supplying fuel under pressure comprises a simple non-return valve. The end of the push member or piston opposite to the surface, is exposed to drain pressure as also is the adjacent end of the valve member. In this form of apparatus the pressure required to lift the valve member from its seating will rise as the peak pressure at the fuel inlet increases. This pressure is known in the art as the "nozzle opening pressure". There is now a requirement that the nozzle opening pressure should rise to a maximum value part way through the speed range of the associated engine when the engine is operated at full fuel. It is required that the nozzle opening pressure should remain substantially constant as the engine speed continues to increase to its allowed maximum value.

It is therefore an object of the invention to provide a nozzle of the kind specified in a simple and convenient form and in which this desideratum is obtained.

According to the invention in a nozzle of the kind specified said surface is defined upon a piston member which engages said valve member, said piston member having a bore formed therein, one end of the bore being open to said chamber and the other end of the bore communicating with a drain, a valve element slidable in the bore, a spring biasing the valve element towards said one end of the bore whereby the position of the valve element within the bore will be dependent upon the pressure in said chamber, and passage means defined by the piston and valve element, said passage means connecting said inlet with said chamber, the flow of fuel into said chamber through said passage means being prevented when the pressure of fuel in the chamber attains a predetermined value.

An example of a fuel injection nozzle in accordance with the invention will now be described with reference to the accompanying drawings in which.

Figure 1:
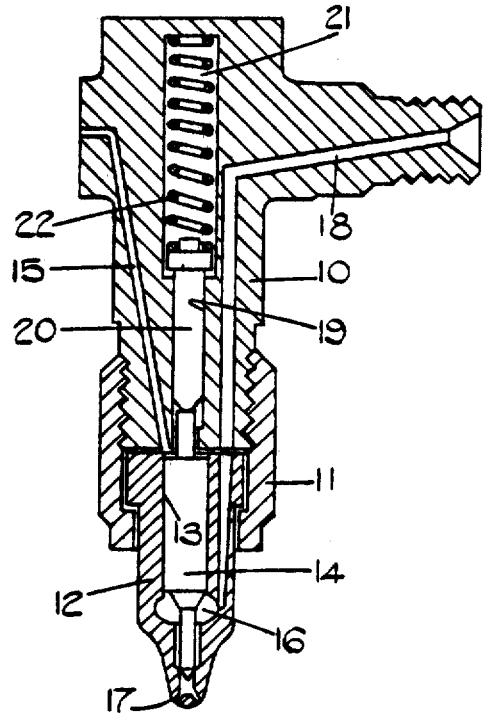
FIG. 1 is a sectional side elevation of a known form of nozzle.

Referring to FIG. 1 of the drawings, the fuel injection nozzle comprises a nozzle holder 10 to which is secured by means of a cap nut 11, a nozzle head 12. Formed in the nozzle head is a bore 13 in which is slidably mounted a valve member 14. The end of the bore adjacent the body communicates with a drain by way of a passage 15 which extends within the body 10 and the other end of the bore terminates in an annular chamber 16 from which extends a reduced portion of the bore which is shaped to define a seating for engagement by a reduced portion of the valve member 14. Outlet orifices 17 extend from the narrower end of this portion of the bore and fuel is supplied to the chamber 16 from an inlet, by way of a passage 18 formed in the nozzle head and the body 10. The fuel inlet in use is connected to an outlet of a fuel injection pump which delivers fuel in timed relationship to the associated engine.

Formed in the body 10 is a further bore 19 in which is mounted a piston 20 which engages with an extending portion of the valve member 14. The bore 19 extends into a chamber 21 which accommodates a coiled compression spring 22 and this is engaged with the piston 20 to bias the piston and also the valve member so that the latter contacts the seating.

Figure 2:
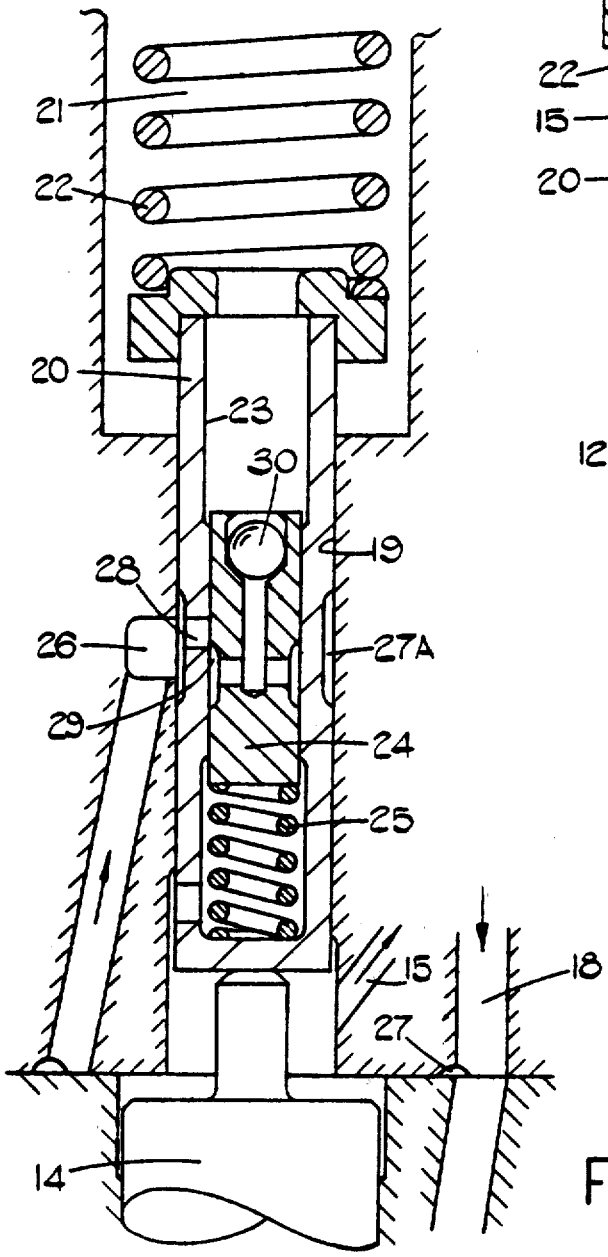
FIG. 2 is a sectional side elevation of part of the nozzle modified in accordance with the invention.

As shown in FIG. 2, the piston 20 is provided with a bore 23 one end of which is open to the chamber 21 whilst the other end is open to the space intermediate the piston and the valve member. Slidable within the bore 23 is a valve element 24 and this is biased towards the chamber by means of a coiled compression spring 25 which locates between the valve element and the end wall of the bore 23.

Opening into the bore 19 is a port 26 which is in constant communication with the passage 18, this being achieved by an annular groove 27 which is formed in the end surface of the body 10. The piston 20 is provided with an elongated circumferential groove 27A which is in constant communication with the port 26 and itself communicates with a port 28 opening into the bore 23.

The valve element 24 is provided with a circumferential groove 29 which communicates by way of passages in the valve element with the chamber 21. A ball check valve 30 is provided in one of the passages to trap the pressure in the chamber 21 although it will be appreciated that in use, the pressure in the chamber 21 will gradually decay due to leakage.

In operation, and ignoring for the moment the effect of the pressure in the chamber 21, when fuel under pressure is supplied to the chamber 16, a force will be exerted upon the valve member acting to lift the valve member against the action of the spring 22 thereby to allow fuel flow through the outlets 17. As soon as the pressure in the passage 18 falls at the end of the delivery of fuel, the spring 22 will urge the valve member 14 back onto its seating. Assuming that the pressure in the chamber 21 is low, the valve element 24 will be moved by its spring 25 to a postion in which the port 28 is in full communication with the groove 29. As a result when fuel is supplied to the passage 18, some fuel will flow by way of the port 28 and the groove 29, to the chamber 21 lifting the ball valve off its seating in the process. This will pressurise the chamber 21. At the end of fuel delivery the ball valve 30 will close onto its seating to prevent escape of the fuel under pressure in the chamber 21. This process is repeated until a point is reached at which the force acting upon the valve element 24 is sufficient to move the valve element against the action of the spring 25 to a postion such that communication between the port 28 and groove 29 is prevented. In this situation therefore no further flow of fuel can take place into the chamber 21. The pressure of fuel in the chamber acts upon the piston 20 and also the valve element 24 to create a force which assists the action of the spring 22. The maximum pressure which can be obtained in the chamber 21 is dependant upon the area of the valve element 24 which is exposed to the pressure and the force exerted by the spring 25. It can be arranged therefore that the pressure in the chamber 21 rises to a predetermined value and will be maintained at this value. If the peak pressure attained in the passage 18 during the delivery of fuel falls below the pressure at which the valve element closes communication between the port 28 and the groove 29, the pressure within the chamber 21 will fall due to fuel leakage.

The practical effect is that the nozzle opening pressure increases up to a predetermined value and then is maintained substantially constant irrespective of any increase in the peak pressure which is attained during the delivery of fuel by the associated injection pump.

I claim:

1. A fuel injection nozzle comprising a fluid pressure operable valve member slidable within a bore, a seating located at one end of the bore, the valve member being shaped for cooperation with said seating to prevent fuel flow from an inlet to an outlet, resilient means biasing the valve member into contact with the seating, a chamber, a valve means through which fuel under pressure can flow to said chamber, a surface in said chamber, the fuel pressure in said chamber acting on said surface to create a force which assists the action of said resilient means, said surface being defined upon a piston member which engages said valve member, said valve means including a bore formed in the piston member, one end of the bore being open to said chamber and the other end of the bore communicating with a drain, a valve element slidable in the bore, a spring biasing the valve element towards said one end of the bore whereby the position of the valve element within the bore will be dependent upon the pressure in said chamber, passage means defined by the piston and valve element, said passage means connecting said inlet with said chamber, the flow of fuel through said passage means into said chamber being prevented when the pressure of fuel in the chamber attains a predetermined value, and a non-return valve in said passage means, said non-return valve acting to prevent fuel flow through said passage means from the chamber.

2. A nozzle according to claim 1, in which said non-return valve comprises a ball check valve located in a passage in the valve element, said passage forming part of said passage means.

3. A nozzle according to claim 2, including a port formed in the wall of said bore, and a circumferential groove in the valve element, said groove being connected by way of said passage to said chamber and said port being connected to said inlet.

4. A nozzle according to any one of the claims 1, 2 or 3, in which said piston member transmits the force exerted by said resilient means to the valve member.

* * * * *